US009671161B2

(12) United States Patent
Sicinski et al.

(10) Patent No.: US 9,671,161 B2
(45) Date of Patent: Jun. 6, 2017

(54) CONTROLLING LIQUEFACTION OF NATURAL GAS

(75) Inventors: Michael Andrew Sicinski, Orefield, PA (US); Brian Keith Johnston, Schnecksville, PA (US); Scott Robert Trautmann, Macungie, PA (US); Mark Julian Roberts, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 1025 days.

(21) Appl. No.: 13/314,882

(22) Filed: Dec. 8, 2011

(65) Prior Publication Data

US 2012/0079850 A1 Apr. 5, 2012

Related U.S. Application Data

(63) Continuation of application No. 11/782,990, filed on Jul. 25, 2007, now abandoned.

(51) Int. Cl.
*F25J 1/00* (2006.01)
*F25J 1/02* (2006.01)

(52) U.S. Cl.
CPC ..... *F25J 1/0249* (2013.01); *F25J 1/0022* (2013.01); *F25J 1/0055* (2013.01); *F25J 1/0244* (2013.01); *F25J 1/0292* (2013.01)

(58) Field of Classification Search
CPC ..... F25J 1/0022; F25J 1/0244; F25J 1/0252; F25J 1/0254; F25J 1/0214; F25J 1/0249; F25J 1/025; F25J 1/0251; F25J 2270/12; F25J 2270/18; F25J 2270/16
USPC ..... 62/606, 611, 612, 614, 657
See application file for complete search history.

(56) References Cited

U.S. PATENT DOCUMENTS

| | | | | |
|---|---|---|---|---|
| 3,559,418 A * | 2/1971 | Hoffman | F25J 3/0209 62/622 |
| 3,599,418 A * | 8/1971 | Hill | 57/258 |
| 3,742,721 A | 7/1973 | Bourguet et al. | |
| 4,809,154 A | 2/1989 | Newton | |
| 5,139,548 A | 8/1992 | Liu et al. | |
| 5,791,160 A * | 8/1998 | Mandler | F25J 1/0022 62/611 |

(Continued)

FOREIGN PATENT DOCUMENTS

| | | |
|---|---|---|
| JP | 6325481 | 2/1988 |
| JP | 5196349 | 8/1993 |

(Continued)

OTHER PUBLICATIONS

Narayanan K: "Controlling Complex Turbomachines in LNG Plants"; AICHE Spring Meeting. Natural Gas Utilization Conference. X. US, Apr. 14, 2005, p. 283-294.

(Continued)

*Primary Examiner* — Frantz Jules
*Assistant Examiner* — Brian King
(74) *Attorney, Agent, or Firm* — Eric J. Schaal; Willard Jones, II

(57) ABSTRACT

A gas liquefaction process, especially for producing LNG, maintains product flow rate and temperature by controlling the refrigeration so that variation to reduce any difference between actual and required product temperatures is initiated before variation of the product flow rate to reduce any difference between actual and required flow rates.

19 Claims, 7 Drawing Sheets

(56) References Cited

U.S. PATENT DOCUMENTS

| | | | | |
|---|---|---|---|---|
| 6,272,882 | B1 * | 8/2001 | Hodges | F25J 1/0022 62/613 |
| 6,347,532 | B1 | 2/2002 | Agrawal et al. | |
| 6,553,772 | B1 | 4/2003 | Belanger et al. | |
| 6,725,688 | B2 | 4/2004 | Elion et al. | |
| 6,789,394 | B2 | 9/2004 | Elion et al. | |
| 7,266,975 | B2 * | 9/2007 | Hupkes-Van Der Toorn et al. | 62/612 |
| 2004/0255615 | A1 | 12/2004 | Hupkes et al. | |
| 2005/0288801 | A1 | 12/2005 | Rutherford | |
| 2006/0260355 | A1 | 11/2006 | Roberts et al. | |
| 2008/0307826 | A1 * | 12/2008 | Coward | F25J 1/0022 62/611 |

FOREIGN PATENT DOCUMENTS

| | | |
|---|---|---|
| JP | 11092770 | 4/1999 |
| JP | 2003532047 | 10/2003 |
| JP | 2006516715 | 7/2006 |
| WO | 0181845 | 11/2001 |
| WO | 2008056269 A1 | 5/2008 |

OTHER PUBLICATIONS

Valappil J V et al: "Improving Profitability of LNG Plants using Advanced Process Control", AICHE Spring Meeting. Natural Gas Utilization Conference . X. US. Jan. 1, 2007; p. 174-179.

* cited by examiner

CONTROLLING LIQUEFACTION OF NATURAL GAS

BACKGROUND OF THE INVENTION

This invention relates to the field of control systems for production of liquefied gas (LG), and more specifically, to a process and system which controls LG production and LG temperature. It has particular but not exclusive application to liquefying natural gas (NG) to produce liquefied natural gas (LNG).

Systems for the liquefaction of natural gas (NG) by refrigeration in heat exchange means, especially using a multicomponent refrigerant, are in use throughout the world. Control of the LNG production process is important to operate a plant efficiently, especially when attempting to meet demands for incremental production for downstream processing or when attempting to adjust to external process disturbances. Essentially simultaneous and independent control of both the LNG production flow rate and temperature is important for LNG plant operation. By fixing and maintaining the LNG production rate, plant operators can adequately plan and achieve desired production levels as required by the product shipping schedule. Maintaining the temperature of the LNG within a specified range is important for downstream processing and the prevention of downstream equipment problems. Once regulatory control is achieved for the key variables, optimization strategies can be properly implemented. However, if regulatory control is not adequate, even standard day to day operation is adversely affected.

In typical NG liquefaction processes, natural gas is fed to the warm end of heat exchange means, having a liquefying section in which the natural gas is liquefied and a subcooling section in which the liquefied natural gas is subcooled, and the LNG outlet stream is withdrawn from the cold end of the heat exchange means. Some refrigeration duty in the liquefying section is provided by flashing a first refrigerant ("MRL"), provided by cooling in the heat exchange means the liquid portion of a phase separation of a multicomponent refrigerant (MR) and refrigeration duty in the subcooling section is provided by flashing a second refrigerant ("MRV"), provided by condensing in the heat exchange means the vapor portion of the MR phase separation. The remainder of the refrigeration duty in the liquefying section is provided by spent MRV from the liquefaction section. The refrigerants exiting the warm end of the heat exchanger means are combined, if not already mixed in the liquefaction section, compressed and precooled before return to the MR phase separation for recycle to the heat exchange means. A process having the aforementioned features is referred to herein as "a typical NG liquefaction process".

U.S. Pat. No. 5,791,160 (Mandler et al; corresponding to EP-A-0893665) describes a natural gas liquefaction control scheme where LNG product flow rate and temperature are simultaneously and independently controlled by adjusting the amount of refrigeration. In the exemplified embodiments, the control variables (the ones having a set point that can be changed by the operator) of a typical NG liquefaction process include LNG product flow rate and temperature as well as the MRL/MRV ratio. Manipulated variables (the ones that are automatically controlled in response to operator setting of one or more of the control variables) include MR compressor speed and MR/LNG ratio. In this scheme the amount of refrigeration is adjusted after the actual LNG product flow rate has been changed in response to a change in the LNG product flow rate set point.

U.S. Pat. No. 6,725,688 (Elion et al; corresponding to WO-A-01/81845) describes a modification of Mandler et al with the object of maximizing power utilization. LNG product temperature and MRL/MRV ratio are retained as controlled variables and the manipulated variable is LNG/MRL ratio but LNG product flow rate cannot be independently set.

U.S. Patent Application Publication 2004/0255615 (Hupkes et al; corresponding to WO-A-2004/068049 & EP-A-1595101) describes the use of an advanced process controller based on model-predictive control to control a typical NG liquefaction process. The controller determines simultaneous control actions for a set of manipulated variables in order to optimize at least one of a set of parameters including the production of liquefied product whilst controlling at least one of a set of controlled variables. The set of manipulated variables includes MRL flow rate, MRV flow rate, MR composition, MR removal, MR compressor capacity and NG feed flow rate. The set of controlled variables includes the temperature difference at the warm end of the main heat exchanger, an adjustable relating to the LNG temperature, the composition of the refrigerant entering the MR phase separator, the pressure in the shell of the main heat exchanger, and the pressure and liquid level in MR phase separator.

There is a need to develop a simple and robust control scheme that allows control of LNG product temperature and flow rate without subjecting the heat exchange means to thermal stresses and without the need to manipulate the MR compressor and it is an object of the present invention to meet that need.

BRIEF SUMMARY OF THE INVENTION

A control system for typical NG liquefaction processes has been devised in which the thermal stress on the heat exchange means is limited and the need to manipulate the MR compressor can be avoided by controlling the refrigeration so that variation to reduce any difference between actual and required LNG temperature is initiated before variation of the LNG product flow rate to reduce any difference between actual and required LNG flow rate. Accordingly, refrigeration leads LG production. The invention has particular, but not exclusive, application to a typical NG liquefaction process in which the controlled variables are LNG temperature, LNG flow rate and either heat exchanger warm end temperature difference ("WETD") or heat exchanger mid-point temperature ("MPT") and the manipulated variables are MRL and MRV flow rates. However, the invention is not restricted to the control of NG liquefaction processes but is more generally applicable to gas liquefaction, e.g. of hydrocarbon mixtures.

In one of its broadest aspects, the invention provides a method of maintaining at an adjustable predetermined flow rate value and at an adjustable predetermined temperature value the liquefied gas ("LG") outlet stream of a gas liquefaction in which a gas feed is liquefied by refrigeration in heat exchange means, comprising the steps of:

setting the predetermined flow rate value for the LG outlet stream and comparing said value with the actual LG flow rate;

setting the predetermined temperature value for the LG outlet stream and comparing said LNG temperature value with the actual LG temperature;

varying the refrigeration provided by said heat exchange means in response to said LG flow rate and LG temperature comparisons to reduce any differences, characterized in that the refrigeration is varied to reduce any LG temperature difference before variation of the LG flow rate to reduce any LG flow rate difference. Thus, this aspect allows the LG flow rate and temperature to be independently set and refrigeration to be correspondingly adjusted to meet the set requirements with limited thermal stress on the heat exchange means. However, the control system concept of the invention is applicable to LG liquefaction processes in which the LG flow rate and temperature requirements are constant but from time to time some variation is required to the actual values in order to compensate for a change in other parameters, such as NG feed temperature and composition, MR composition, ambient air temperature, cooling water temperature, atmospheric pressure etc., that has caused the actual value to deviate from the required value.

The invention also provides a control system for maintaining at an adjustable predetermined flow rate value and at an adjustable predetermined temperature value the liquefied gas ("LG") outlet stream of a gas liquefaction in which a gas feed is liquefied by refrigeration in heat exchange means, comprising:

means for setting the predetermined flow rate value for the LG outlet stream and comparing said value with the actual LG flow rate;

means for varying the actual LG product flow rate;

means for setting the predetermined temperature value for the LG outlet stream and comparing said LNG temperature value with the actual LG temperature; and means for varying the refrigeration provided by said heat exchange means in response to said LG flow rate and LG temperature comparisons to reduce any differences, characterized in that means for varying the actual LG product flow rate is not adjusted until the refrigeration has been adjusted to reduce any LG temperature difference.

DETAILED DESCRIPTION OF THE INVENTION

Figure 1:
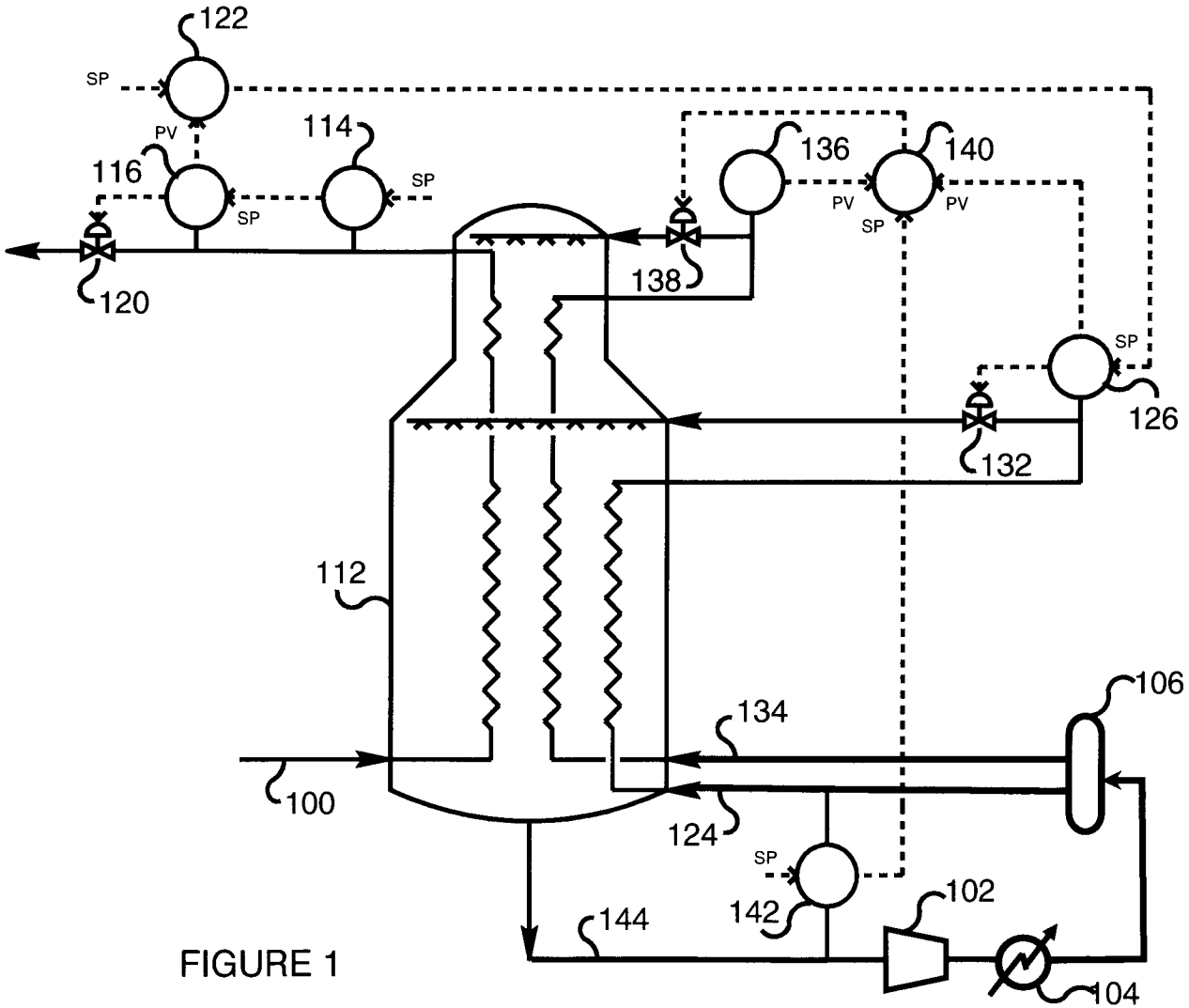
FIG. 1 is a schematic flow diagram of a mixed refrigerant LNG plant process of a first exemplary embodiment of the present invention.

The present invention relates to the control of liquefaction of gas, especially natural gas, in a manner that maintains the LG product at a required flow rate and temperature with limited thermal stress on the heat exchange means even when the LG flow rate and/or temperature requirements have been changed. The invention resides in the manner in which refrigeration is changed by manipulated variables.

In one broad aspect, the invention provides a method of maintaining at an adjustable predetermined flow rate value and at an adjustable predetermined temperature value the liquefied gas ("LG") outlet stream of a gas liquefaction in which a gas feed is liquefied by refrigeration in heat exchange means, comprising the steps of:

setting the predetermined flow rate value for the LG outlet stream and comparing said value with the actual LG flow rate;

setting the predetermined temperature value for the LG outlet stream and comparing said LG temperature value with the actual LG temperature; and varying the refrigeration provided by said heat exchange means in response to said LG flow rate and LG temperature comparisons to reduce any differences, characterized in that the refrigeration is varied to reduce any LG temperature difference before variation of the LG flow rate to reduce any LG flow rate difference.

In a corresponding apparatus aspect, the invention also provides a control system for maintaining at an adjustable predetermined flow rate value and at an adjustable predetermined temperature value the liquefied gas ("LG") outlet stream of a gas liquefaction in which a gas feed is liquefied by refrigeration in heat exchange means, comprising:

means for setting the predetermined flow rate value for the LG outlet stream and comparing said value with the actual LG flow rate;

means for varying the actual LG product flow rate;

means for setting the predetermined temperature value for the LG outlet stream and comparing said LNG temperature value with the actual LG temperature; and means for varying the refrigeration provided by said heat exchange means in response to said LG flow rate and LG temperature comparisons to reduce any differences, characterized in that the means for varying the actual LG product flow rate is not adjusted until the refrigeration has been adjusted to reduce any LG temperature difference.

In another broad aspect, the invention also provides a method of maintaining at a predetermined flow rate value and at a predetermined temperature value the liquefied gas ("LG") outlet stream of a gas liquefaction in which a gas feed is liquefied by refrigeration in heat exchange means, comprising the steps of:

comparing said predetermined LG flow rate value with the actual LG flow rate;

comparing said predetermined LG temperature value with the actual LG temperature; and varying the refrigeration provided by said heat exchange means in response to said LG flow rate and LG temperature comparisons to reduce any differences, characterized in that the refrigeration is varied to reduce any LG temperature difference before variation of the LNG flow rate to reduce any LG flow rate difference.

In a corresponding apparatus aspect, the invention also provides a control system for maintaining at a predetermined flow rate value and at a predetermined temperature value the liquefied gas ("LG") outlet stream of a gas liquefaction in which a gas feed is liquefied by refrigeration in heat exchange means, comprising:

means for comparing said predetermined LG flow rate value with the actual LG flow rate;

means for comparing said predetermined LG temperature value with the actual LG temperature; and means for varying the actual LG product flow rate;

means for varying the refrigeration provided by said heat exchange means in response to said LG flow rate and LG temperature comparisons to reduce any differences, characterized in that the means for varying the LNG flow rate is not adjusted until the refrigeration has been varied to reduce any LG temperature difference.

The invention has particular application to typical NG liquefaction processes and in a preferred embodiment provides a method of maintaining at an adjustable predetermined flow rate value and at an adjustable predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

setting the predetermined flow rate value for the LNG outlet stream and comparing said value with the actual LNG flow rate;

setting the predetermined temperature value for the LNG outlet stream and comparing said LNG temperature value with the actual LNG temperature;

setting a predetermined value of (i) the temperature difference between spent refrigerant leaving the warm end of the heat exchange means and a stream entering said warm end selected from MRL, MRV and the natural gas feed ("warm end temperature difference value") or (ii) the temperature of a stream at a location between the liquefying and subcooling sections of the heat exchanger means ("mid-point temperature") and comparing same with the actual warm end temperature difference or actual mid-point temperature respectively;

varying, by an amount corresponding to the difference between the actual and predetermined LNG flow rates, one of the MRL and MRV flow rates;

varying the other of the MRV and MRL flow rates to maintain an MRL/MRV ratio, which ratio is determined by one of (a) the difference between the actual and predetermined LNG temperatures and (b) the difference between the actual and predetermined warm end temperature differences or mid-point temperatures; and varying, by an amount corresponding to the other of (b) the difference between the actual and predetermined warm end temperature differences or mid-point temperatures and (a) the difference between the actual and predetermined LNG temperatures, the actual LNG flow rate.

In a corresponding apparatus aspect, the invention provides a control system for maintaining at an adjustable predetermined flow rate value and at an adjustable predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising:

means for setting the predetermined flow rate value for the LNG outlet stream and comparing said value with the actual LNG flow rate;

means for setting the predetermined temperature value for the LNG outlet stream and comparing said LNG temperature value with the actual LNG temperature;

means for setting a predetermined value of (i) the temperature difference between spent refrigerant leaving the warm end of the heat exchange means and a stream entering said warm end selected from MRL, MRV and the natural gas feed ("warm end temperature difference value") or (ii) the temperature of a stream at a location between the liquefying and subcooling sections of the heat exchanger means ("mid-point temperature") and comparing same with the actual warm end temperature difference or actual mid-point temperature respectively;

means for varying, by an amount corresponding to the difference between the actual and predetermined LNG flow rates, one of the MRL and MRV flow rates;

means for varying the other of the MRV and MRL flow rates to maintain an MRL/MRV ratio, which ratio is determined by one of (a) the difference between the actual and predetermined LNG temperatures and (b) the difference between the actual and predetermined warm end temperature differences or mid-point temperatures; and means for varying, by an amount corresponding to the other of (b) the difference between the actual and predetermined warm end temperature differences or mid-point temperatures and (a) the difference between the actual and predetermined LNG temperatures, the actual LNG flow rate.

Another preferred embodiment of the invention provides a method of maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

comparing said predetermined LNG flow rate value with the actual LNG flow rate;

comparing said predetermined LNG temperature value with the actual LNG temperature;

comparing a predetermined value of (i) the temperature difference between spent refrigerant leaving the warm end of the heat exchange means and a stream entering said warm end selected from MRL, MRV and the natural gas feed ("warm end temperature difference value") or (ii) the temperature of a stream at a location between the liquefying and subcooling sections of the heat exchanger means ("mid-point temperature") with the actual warm end temperature difference or actual mid-point temperature respectively;

varying, by an amount corresponding to the difference between the actual and predetermined LNG flow rates, one of the MRL and MRV flow rates;

varying the other of the MRV and MRL flow rates to maintain an MRL/MRV ratio, which ratio is determined by one of (a) the difference between the actual and predetermined LNG temperatures and (b) the difference between the actual and predetermined warm end temperature differences or mid-point temperatures; and varying, by an amount corresponding to the other of (b) the difference between the actual and predetermined warm end temperature differences or mid-point temperatures and (a) the difference between the actual and predetermined LNG temperatures, the actual LNG flow rate.

In a corresponding apparatus embodiment, the invention provides a control system for maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising:

means for comparing said predetermined LNG flow rate value with the actual LNG flow rate;

means for comparing said predetermined LNG temperature value with the actual LNG temperature;

means for comparing a predetermined value of (i) the temperature difference between spent refrigerant leaving the warm end of the heat exchange means and a stream entering said warm end selected from MRL, MRV and the natural gas feed ("warm end temperature difference value") or (ii) the temperature of a stream at a location between the liquefying and subcooling sections of the heat exchanger means ("mid-point temperature") with the actual warm end temperature difference or actual mid-point temperature respectively;

means for varying, by an amount corresponding to the difference between the actual and predetermined LNG flow rates, one of the MRL and MRV flow rates;

means for varying the other of the MRV and MRL flow rates to maintain an MRL/MRV ratio, which ratio is determined by one of (a) the difference between the actual and predetermined LNG temperatures and (b) the difference between the actual and predetermined warm end temperature differences or mid-point temperatures; and means for varying, by an amount corresponding to the other of (b) the difference between the actual and predetermined warm end temperature differences or mid-point temperatures and (a) the difference between the actual and predetermined LNG temperatures, the actual LNG flow rate.

In accordance with an embodiment illustrated in FIG. 1, the warm end temperature difference value is predetermined; the MRL flow rate is adjusted in response to the difference between actual and predetermined LNG product flow rates and hence the LNG/MRL ratio changed; the required MRL/MRV ratio is adjusted in response to the difference between actual and predetermined warm end temperature difference value and the MRV flow rate adjusted to achieve that ratio; and the actual flow rate is adjusted in response to the difference between actual and predetermined LNG product temperatures.

Thus, in accordance with the embodiment illustrated in FIG. 1, the invention provides a method of maintaining at an adjustable predetermined flow rate value and at an adjustable predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

setting the predetermined flow rate value for the LNG outlet stream and comparing said value with the actual LNG flow rate;

setting the predetermined temperature value for the LNG outlet stream and comparing said LNG temperature value with the actual LNG temperature;

setting a predetermined value of the temperature difference between spent refrigerant leaving the warm end of the heat exchange means and a stream entering said warm end selected from MRL, MRV and the natural gas feed ("warm end temperature difference value") and comparing same with the actual warm end temperature difference;

varying, by an amount corresponding to the difference between the actual and predetermined LNG flow rates, the MRL flow rate;

varying the MRV flow rate to maintain an MRL/MRV ratio, which ratio is determined by the difference between the actual and predetermined warm end temperature differences; and varying, by an amount corresponding to the difference between the actual and predetermined LNG temperatures, the actual LNG flow rate.

In a corresponding apparatus embodiment, the invention provides a control system for maintaining at an adjustable predetermined flow rate value and at an adjustable predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising:

means for setting the predetermined flow rate value for the LNG outlet stream and comparing said value with the actual LNG flow rate;

means for setting the predetermined temperature value for the LNG outlet stream and comparing said LNG temperature value with the actual LNG temperature;

means for setting a predetermined value of the temperature difference between spent refrigerant leaving the warm end of the heat exchange means and a stream entering said warm end selected from MRL, MRV and the natural gas feed ("warm end temperature difference value") and comparing same with the actual warm end temperature difference;

means for varying, by an amount corresponding to the difference between the actual and predetermined LNG flow rates, the MRL flow rate;

means for varying the MRV flow rate to maintain an MRL/MRV ratio, which ratio is determined by the difference between the actual and predetermined warm end temperature differences; and means for varying, by an amount corresponding to the difference between the actual and predetermined LNG temperatures, the actual LNG flow rate.

Also in accordance with an embodiment illustrated in FIG. 1, the invention provides a method of maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

comparing said predetermined LNG flow rate value with the actual LNG flow rate;

comparing said predetermined LNG temperature value with the actual LNG temperature;

comparing a predetermined value of the temperature difference between spent refrigerant leaving the warm end of the heat exchange means and a stream entering said warm end selected from MRL, MRV and the natural gas feed ("warm end temperature difference value") with the actual warm end temperature difference;

varying, by an amount corresponding to the difference between the actual and predetermined LNG flow rates, the MRL flow rate;

varying the MRV flow rate to maintain an MRL/MRV ratio, which ratio is determined by the difference between the actual and predetermined warm end temperature differences; and varying, by an amount corresponding to the difference between the actual and predetermined LNG temperatures, the actual LNG flow rate.

In a corresponding apparatus embodiment, the invention provides a control system for maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising:

means for comparing said predetermined LNG flow rate value with the actual LNG flow rate;

means for comparing said predetermined LNG temperature value with the actual LNG temperature;

means for comparing a predetermined value of the temperature difference between spent refrigerant leaving the warm end of the heat exchange means and a stream entering said warm end selected from MRL, MRV and the natural gas feed ("warm end temperature difference value") with the actual warm end temperature difference;

means for varying, by an amount corresponding to the difference between the actual and predetermined LNG flow rates, the MRL flow rate;

means for varying the MRV flow rate to maintain an MRL/MRV ratio, which ratio is determined by the difference between the actual and predetermined warm end temperature differences; and means for varying, by an amount corresponding to the difference between the actual and predetermined LNG temperatures, the actual LNG flow rate.

Figure 2:
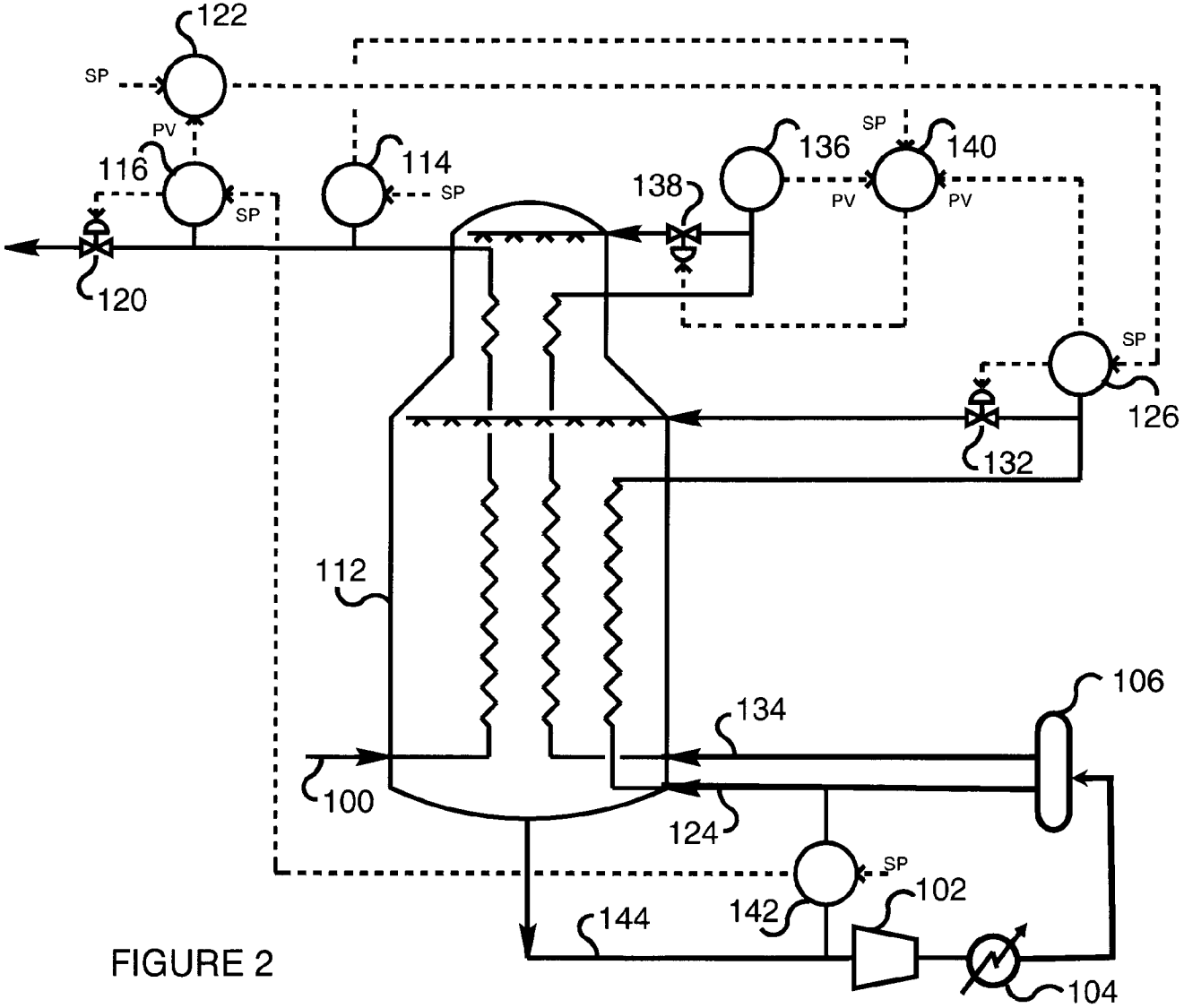
FIG. 2 is a schematic flow diagram of a mixed refrigerant LNG plant process of a second exemplary embodiment of the present invention.

In accordance with an embodiment illustrated in FIG. 2, the warm end temperature difference value is predetermined; the MRL flow rate is adjusted in response to the difference between actual and predetermined LNG product flow rates and hence the LNG/MRL ratio changed; the required MRL/MRV ratio is adjusted in response to the difference between actual and predetermined LNG product temperatures and the MRV flow rate adjusted to achieve that ratio; and the actual flow rate is adjusted in response to the difference between actual and predetermined warm end temperature difference values.

Thus, in accordance with an embodiment illustrated in FIG. 2, the invention provides a method of maintaining at an adjustable predetermined flow rate value and at an adjustable predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

setting the predetermined flow rate value for the LNG outlet stream and comparing said value with the actual LNG flow rate;

setting the predetermined temperature value for the LNG outlet stream and comparing said LNG temperature value with the actual LNG temperature;

setting a predetermined value of the temperature difference between spent refrigerant leaving the warm end of the heat exchange means and a stream entering said warm end selected from MRL, MRV and the natural gas feed ("warm end temperature difference value") and comparing same with the actual warm end temperature difference;

varying, by an amount corresponding to the difference between the actual and predetermined LNG flow rates, the MRL flow rate;

varying the MRV flow rate to maintain an MRL/MRV ratio, which ratio is determined by the difference between the actual and predetermined LNG temperatures; and varying, by an amount corresponding to the difference between the actual and predetermined warm end temperature differences, the actual LNG flow rate.

In a corresponding apparatus embodiment, the invention provides a control system for maintaining at an adjustable predetermined flow rate value and at an adjustable predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising:

means for setting the predetermined flow rate value for the LNG outlet stream and comparing said value with the actual LNG flow rate;

means for setting the predetermined temperature value for the LNG outlet stream and comparing said LNG temperature value with the actual LNG temperature;

means for setting a predetermined value of the temperature difference between spent refrigerant leaving the warm end of the heat exchange means and a stream entering said warm end selected from MRL, MRV and the natural gas feed ("warm end temperature difference value") and comparing same with the actual warm end temperature difference;

means for varying, by an amount corresponding to the difference between the actual and predetermined LNG flow rates, the MRL flow rate;

means for varying the MRV flow rate to maintain an MRL/MRV ratio, which ratio is determined by the difference between the actual and predetermined LNG temperatures; and means for varying, by an amount corresponding to the difference between the actual and predetermined warm end temperature differences, the actual LNG flow rate.

Also in accordance with an embodiment illustrated in FIG. 2, the invention provides a method of maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

comparing said predetermined LNG flow rate value with the actual LNG flow rate;

comparing said predetermined LNG temperature value with the actual LNG temperature;

comparing a predetermined value of the temperature difference between spent refrigerant leaving the warm end of the heat exchange means and a stream entering said warm end selected from MRL, MRV and the natural gas feed ("warm end temperature difference value") with the actual warm end temperature difference;

varying, by an amount corresponding to the difference between the actual and predetermined LNG flow rates, the MRL flow rate;

varying the MRV flow rate to maintain an MRL/MRV ratio, which ratio determined by the difference between the actual and predetermined LNG temperatures; and varying, by an amount corresponding to the difference between the actual and predetermined warm end temperature differences, the actual LNG flow rate.

In accordance with a corresponding apparatus embodiment, the invention provides a control system for maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising:

means for comparing said predetermined LNG flow rate value with the actual LNG flow rate;

means for comparing said predetermined LNG temperature value with the actual LNG temperature;

means for comparing a predetermined value of the temperature difference between spent refrigerant leaving the warm end of the heat exchange means and a stream entering said warm end selected from MRL, MRV and the natural gas feed ("warm end temperature difference value") with the actual warm end temperature difference;

means for varying, by an amount corresponding to the difference between the actual and predetermined LNG flow rates, the MRL flow rate;

means for varying the MRV flow rate to maintain an MRL/MRV ratio, which ratio determined by the difference between the actual and predetermined LNG temperatures; and means for varying, by an amount corresponding to the difference between the actual and predetermined warm end temperature differences, the actual LNG flow rate.

Figure 3:
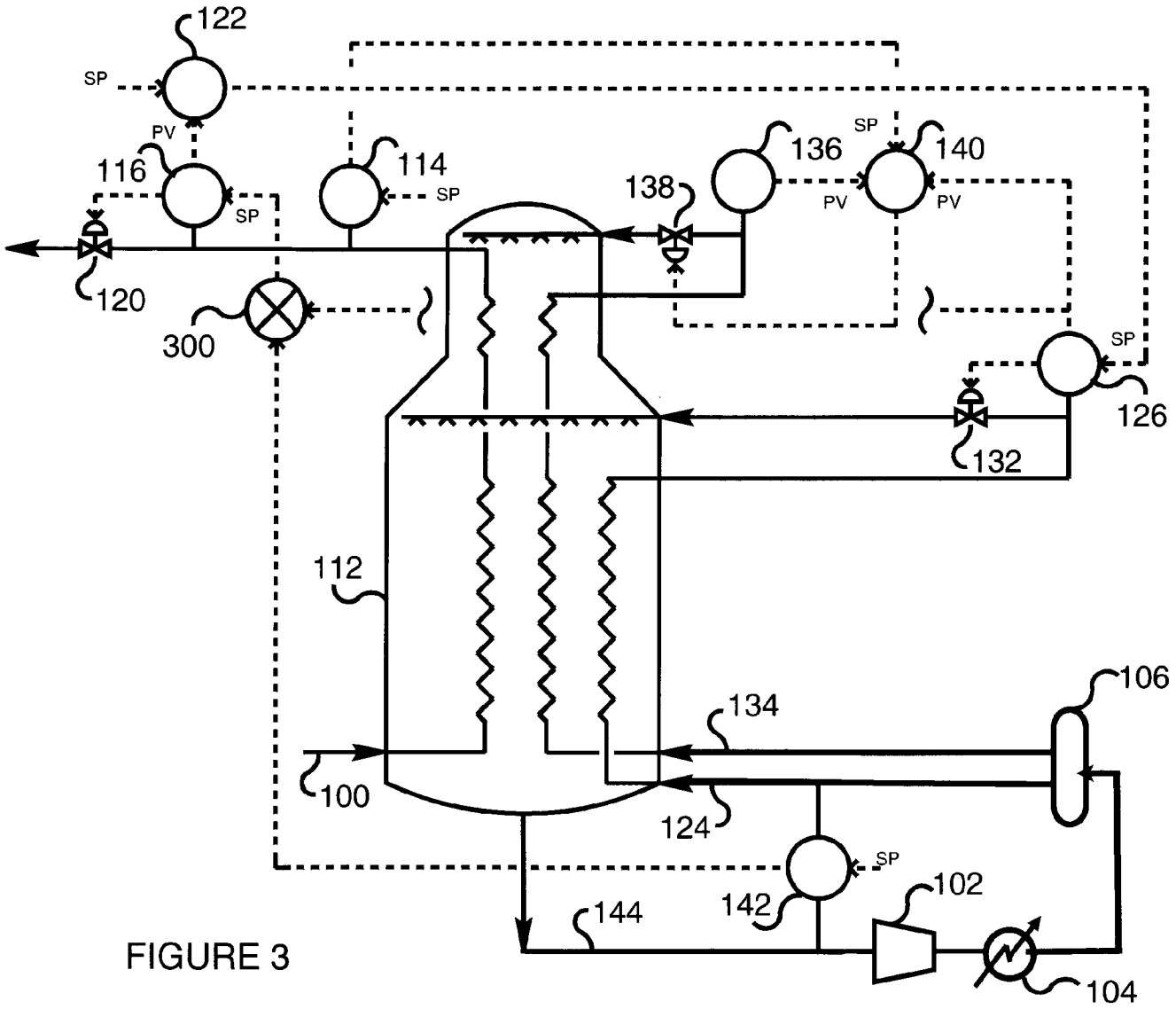
FIG. 3 is a schematic flow diagram of a mixed refrigerant LNG plant process of a third exemplary embodiment of the present invention.

In accordance with an embodiment illustrated in FIG. 3, the warm end temperature difference value is predetermined; the MRL flow rate is adjusted in response to the difference between actual and predetermined LNG product flow rates and hence the LNG/MRL ratio changed; the required MRL/MRV ratio is adjusted in response to the difference between actual and predetermined LNG product temperatures and the MRV flow rate adjusted to achieve that ratio; and the actual flow rate is adjusted in response to both the difference between actual and predetermined warm end temperature difference values and the actual MRL flow rate.

Thus, in accordance with an embodiment illustrated in FIG. 3, the invention provides a method of maintaining at an adjustable predetermined flow rate value and at an adjustable predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

setting the predetermined flow rate value for the LNG outlet stream and comparing said value with the actual LNG flow rate;

setting the predetermined temperature value for the LNG outlet stream and comparing said LNG temperature value with the actual LNG temperature;

setting a predetermined value of the temperature difference between spent refrigerant leaving the warm end of the heat exchange means and a stream entering said warm end selected from MRL, MRV and the natural gas feed ("warm end temperature difference value") and comparing same with the actual warm end temperature difference;

varying, by an amount corresponding to the difference between the actual and predetermined LNG flow rates, the MRL flow rate;

varying the MRV flow rate to maintain an MRL/MRV ratio, which ratio is determined by the difference between the actual and predetermined LNG temperatures; and varying, by an amount corresponding to the difference between the actual and predetermined warm end temperature differences multiplied by a value dependent on the actual MRL flow rate, the actual LNG flow rate.

In accordance with a corresponding apparatus embodiment, the invention provides a control system for maintaining at an adjustable predetermined flow rate value and at an adjustable predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising:

means for setting the predetermined flow rate value for the LNG outlet stream and comparing said value with the actual LNG flow rate;

means for setting the predetermined temperature value for the LNG outlet stream and comparing said LNG temperature value with the actual LNG temperature;

means for setting a predetermined value of the temperature difference between spent refrigerant leaving the warm end of the heat exchange means and a stream entering said warm end selected from MRL, MRV and the natural gas feed ("warm end temperature difference value") and comparing same with the actual warm end temperature difference;

means for varying, by an amount corresponding to the difference between the actual and predetermined LNG flow rates, the MRL flow rate;

means for varying the MRV flow rate to maintain an MRL/MRV ratio, which ratio is determined by the difference between the actual and predetermined LNG temperatures; and means for varying, by an amount corresponding to the difference between the actual and predetermined warm end temperature differences multiplied by a value dependent on the actual MRL flow rate, the actual LNG flow rate.

Also in accordance with an embodiment illustrated in FIG. 3, the invention provides a method of maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

comparing said predetermined LNG flow rate value with the actual LNG flow rate;

comparing said predetermined LNG temperature value with the actual LNG temperature;

comparing a predetermined value of the temperature difference between spent refrigerant leaving the warm end of the heat exchange means and a stream entering said warm end selected from MRL, MRV and the natural gas feed ("warm end temperature difference value") with the actual warm end temperature difference;

varying, by an amount corresponding to the difference between the actual and predetermined LNG flow rates, the MRL flow rate;

varying the MRV flow rate to maintain an MRL/MRV ratio, which ratio is determined by the difference between the actual and predetermined LNG temperatures; and varying, by an amount corresponding to the difference between the actual and predetermined warm end temperature differences multiplied by a value dependent on the actual MRL flow rate, the actual LNG flow rate.

In accordance with a corresponding apparatus embodiment, the invention provides a control system for maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising:

means for comparing said predetermined LNG flow rate value with the actual LNG flow rate;

means for comparing said predetermined LNG temperature value with the actual LNG temperature;

means for comparing a predetermined value of the temperature difference between spent refrigerant leaving the warm end of the heat exchange means and a stream entering said warm end selected from MRL, MRV and the natural gas feed ("warm end temperature difference value") with the actual warm end temperature difference;

means for varying, by an amount corresponding to the difference between the actual and predetermined LNG flow rates, the MRL flow rate;

means for varying the MRV flow rate to maintain an MRL/MRV ratio, which ratio is determined by the difference between the actual and predetermined LNG temperatures; and means for varying, by an amount corresponding to the difference between the actual and predetermined warm end temperature differences multiplied by a value dependent on the actual MRL flow rate, the actual LNG flow rate.

Figure 4:
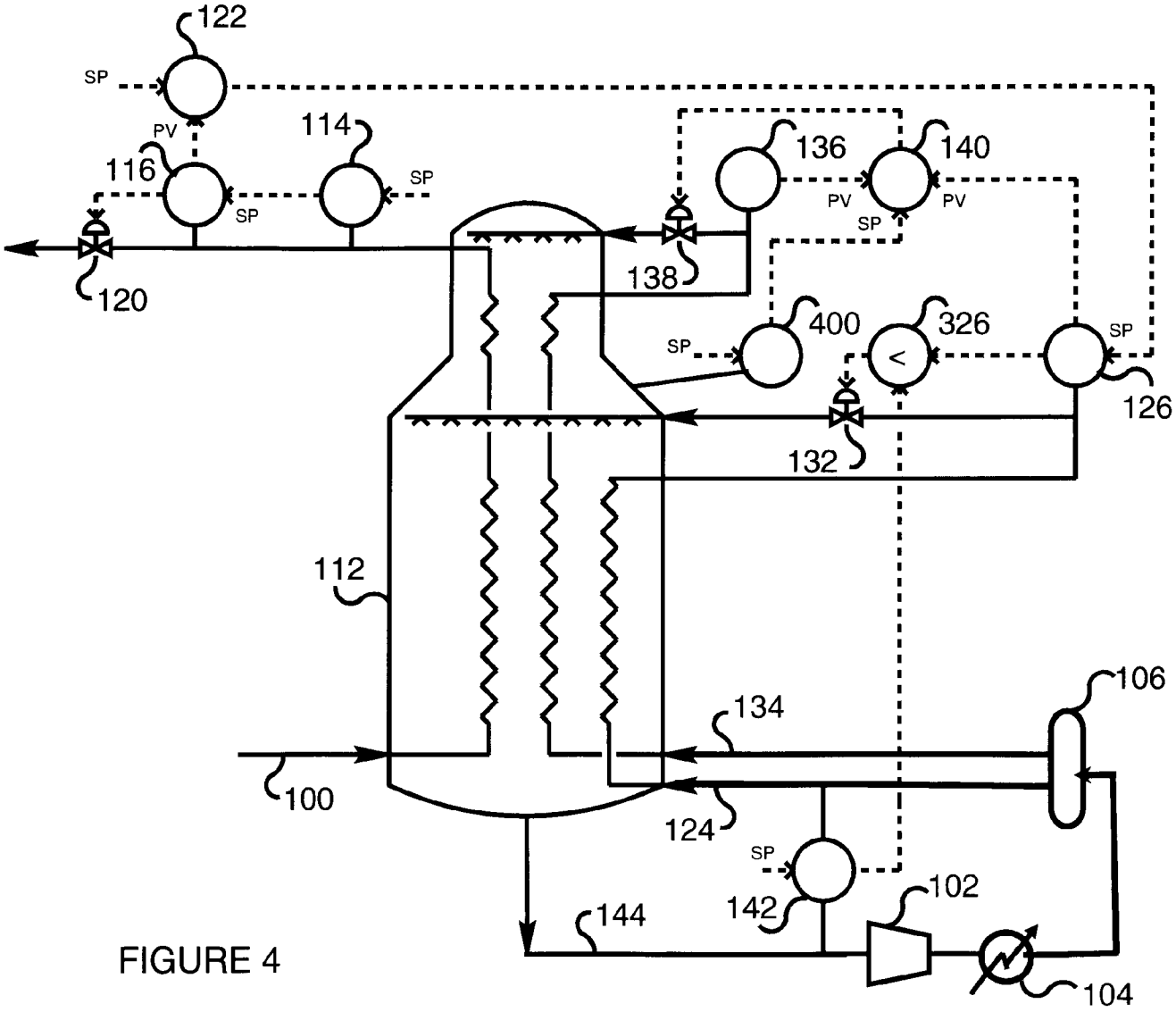
FIG. 4 is a schematic flow diagram of a mixed refrigerant LNG plant process of a fourth exemplary embodiment of the present invention.

In accordance with an embodiment illustrated in FIG. 4, the mid-point temperature difference value is predetermined; the MRL flow rate is adjusted in response to the difference between actual and predetermined LNG product flow rates and hence the LNG/MRL ratio changed; the required MRL/MRV ratio is adjusted in response to the difference between actual and predetermined mid-point temperatures and the MRV flow rate adjusted to achieve that ratio; and the actual flow rate is adjusted in response to the difference between actual and predetermined LNG product temperatures. Preferably, the warm end temperature difference is predetermined and the difference between actual and predetermined warm end temperature differences used as an override control of the MRL flow rate when said difference exceeds a predetermined value.

Thus, in accordance with an embodiment illustrated in FIG. 4, the invention provides a method of maintaining at an adjustable predetermined flow rate value and at an adjustable predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

setting the predetermined flow rate value for the LNG outlet stream and comparing said value with the actual LNG flow rate;

setting the predetermined temperature value for the LNG outlet stream and comparing said LNG temperature value with the actual LNG temperature;

setting a predetermined value of the temperature difference between spent refrigerant leaving the warm end of the heat exchange means and a stream entering said warm end selected from MRL, MRV and the natural gas feed ("warm end temperature difference value") and comparing same with the actual warm end temperature difference;

setting a predetermined value of the temperature of a stream at a location between the liquefying and subcooling sections of the heat exchanger means ("mid-point temperature") and comparing same with the actual mid-point temperature;

varying, by an amount corresponding to the difference between the actual and predetermined LNG flow rates and also, when the difference between actual and predetermined warm end temperature differences exceeds a threshold value, to said difference between warm end temperature differences, MRL flow rate;

varying the MRV flow rate to maintain an MRL/MRV ratio, which ratio is determined by the difference between the actual and predetermined mid-point temperatures; and varying, by an amount corresponding to the difference between the difference between the actual and predetermined LNG temperatures, the actual LNG flow rate.

In accordance with a corresponding apparatus embodiment, the invention provides a control system for maintaining at an adjustable predetermined flow rate value and at an adjustable predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising:

means for setting the predetermined flow rate value for the LNG outlet stream and comparing said value with the actual LNG flow rate;

means for setting the predetermined temperature value for the LNG outlet stream and comparing said LNG temperature value with the actual LNG temperature;

means for setting a predetermined value of the temperature difference between spent refrigerant leaving the warm end of the heat exchange means and a stream entering said warm end selected from MRL, MRV and the natural gas feed ("warm end temperature difference value") and comparing same with the actual warm end temperature difference;

means for setting a predetermined value of the temperature of a stream at a location between the liquefying and subcooling sections of the heat exchanger means ("mid-point temperature") and comparing same with the actual mid-point temperature;

means for varying, by an amount corresponding to the difference between the actual and predetermined LNG flow rates and also, when the difference between actual and predetermined warm end temperature differences exceeds a threshold value, to said difference between warm end temperature differences, MRL flow rate;

means for varying the MRV flow rate to maintain an MRL/MRV ratio, which ratio is determined by the difference between the actual and predetermined mid-point temperatures; and means for varying, by an amount corresponding to the difference between the difference between the actual and predetermined LNG temperatures, the actual LNG flow rate.

Also in accordance with an embodiment illustrated in FIG. 4, the invention provides a method of maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

comparing said predetermined LNG flow rate value with the actual LNG flow rate;

comparing said predetermined LNG temperature value with the actual LNG temperature;

comparing a predetermined value of the temperature difference between spent refrigerant leaving the warm end of the heat exchange means and a stream entering said warm end selected from MRL, MRV and the natural gas feed ("warm end temperature difference value") with the actual warm end temperature difference;

comparing a predetermined value of temperature of a stream at a location between the liquefying and subcooling sections of the heat exchanger means ("mid-point temperature") with the actual mid-point temperature;

varying, by an amount corresponding to the difference between the actual and predetermined LNG flow rates and also, when the difference between actual and predetermined warm end temperature differences exceeds a threshold value, to said difference between warm end temperature differences, the MRL flow rate;

varying the MRV flow rate to maintain an MRL/MRV ratio, which ratio is determined by the difference between the actual and predetermined mid-point temperatures; and varying, by an amount corresponding to the difference between the actual and predetermined LNG temperatures, the actual LNG flow rate.

In accordance with a corresponding apparatus embodiment, the invention provides a control system for maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising:

means for comparing said predetermined LNG flow rate value with the actual LNG flow rate;

means for comparing said predetermined LNG temperature value with the actual LNG temperature;

means for comparing a predetermined value of the temperature difference between spent refrigerant leaving the warm end of the heat exchange means and a stream entering said warm end selected from MRL, MRV and the natural gas feed ("warm end temperature difference value") with the actual warm end temperature difference;

means for comparing a predetermined value of temperature of a stream at a location between the liquefying and subcooling sections of the heat exchanger means ("mid-point temperature") with the actual mid-point temperature;

means for varying, by an amount corresponding to the difference between the actual and predetermined LNG flow rates and also, when the difference between actual and predetermined warm end temperature differences exceeds a threshold value, to said difference between warm end temperature differences, the MRL flow rate;

means for varying the MRV flow rate to maintain an MRL/MRV ratio, which ratio is determined by the difference between the actual and predetermined mid-point temperatures; and means for varying, by an amount corresponding to the difference between the actual and predetermined LNG temperatures, the actual LNG flow rate.

Figure 5:
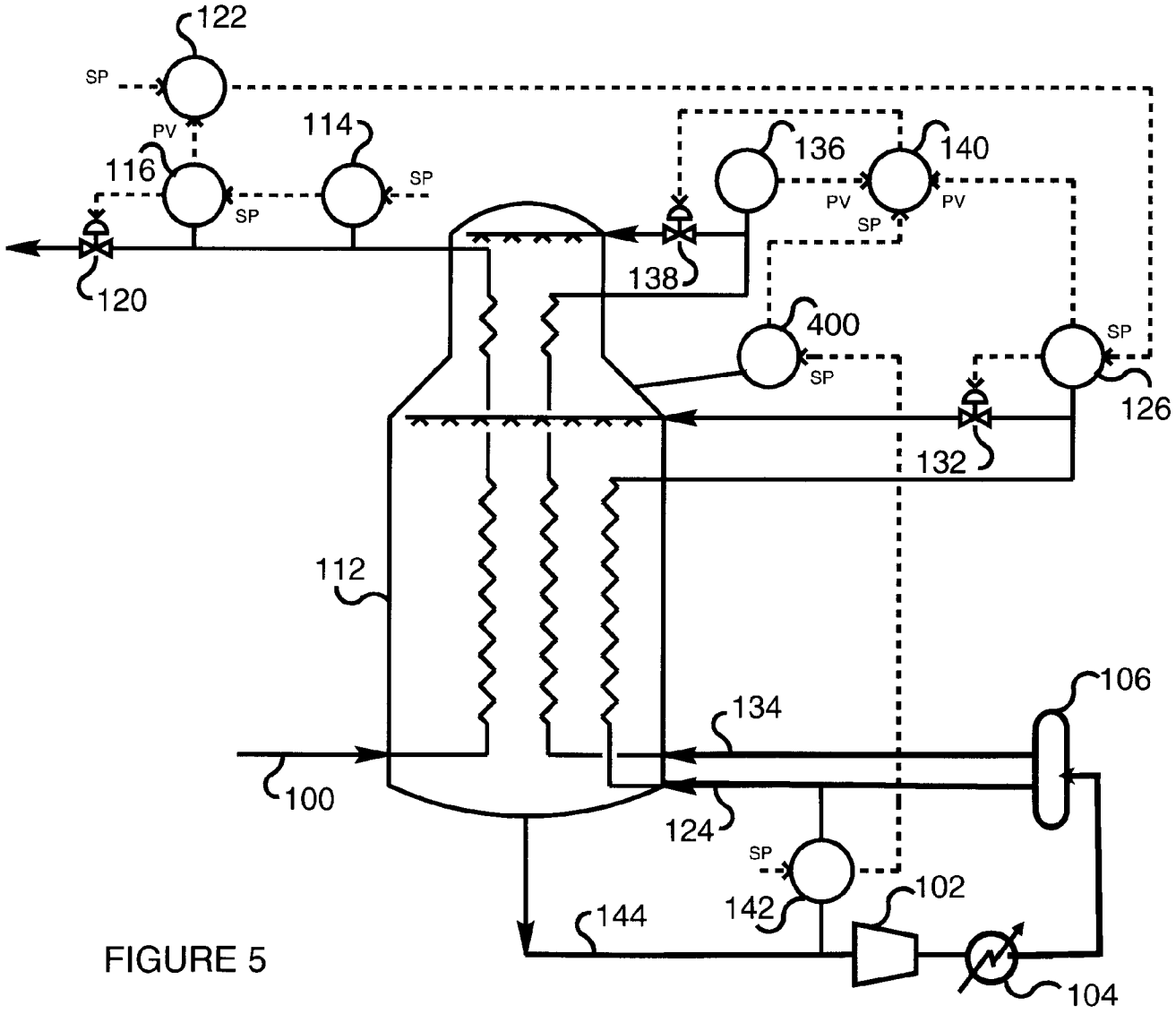
FIG. 5 is a schematic flow diagram of a mixed refrigerant LNG plant process of a fifth exemplary embodiment of the present invention.

In accordance with an embodiment illustrated in FIG. 5, the warm end temperature difference is predetermined; the MRL flow rate is adjusted in response to the difference between actual and predetermined LNG product flow rates and hence the LNG/MRL ratio changed; the required MRL/MRV ratio is adjusted in response to the difference between the actual mid-point temperature and a calculated temperature determined by the difference between the actual and predetermined warm end temperature differences and the MRV flow rate adjusted to achieve that ratio; and the actual flow rate is adjusted in response to the difference between actual and predetermined LNG product temperatures.

Thus, in accordance with an embodiment illustrated in FIG. 5, the invention provides a method of maintaining at an adjustable predetermined flow rate value and at an adjustable predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

setting the predetermined flow rate value for the LNG outlet stream and comparing said value with the actual LNG flow rate;

setting the predetermined temperature value for the LNG outlet stream and comparing said LNG temperature value with the actual LNG temperature;

setting a predetermined value of the temperature difference between spent refrigerant leaving the warm end of the heat exchange means and a stream entering said warm end selected from MRL, MRV and the natural gas feed ("warm end temperature difference value") and comparing said warm end temperature difference value with the actual warm end temperature difference;

comparing the temperature of a stream at a location between the liquefying and subcooling sections of the heat exchanger means ("mid-point temperature") with a calculated temperature value, which is determined by the difference between the actual and predetermined actual warm end temperature differences;

varying, by an amount corresponding to the difference between the actual and predetermined LNG flow rates, the MRL flow rate;

varying the MRV flow rate to maintain an MRL/MRV ratio, which ratio is determined by the difference between the actual and calculated mid-point temperatures; and varying, by an amount corresponding to the difference between the actual and predetermined LNG temperatures, the actual LNG flow rate.

In accordance with a corresponding apparatus embodiment, the invention provides a control system for maintaining at an adjustable predetermined flow rate value and at an adjustable predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising:

means for setting the predetermined flow rate value for the LNG outlet stream and comparing said value with the actual LNG flow rate;

means for setting the predetermined temperature value for the LNG outlet stream and comparing said LNG temperature value with the actual LNG temperature;

means for setting a predetermined value of the temperature difference between spent refrigerant leaving the warm end of the heat exchange means and a stream entering said warm end selected from MRL, MRV and the natural gas feed ("warm end temperature difference value") and comparing said warm end temperature difference value with the actual warm end temperature difference;

means for comparing the temperature of a stream at a location between the liquefying and subcooling sections of the heat exchanger means ("mid-point temperature") with a calculated temperature value, which is determined by the difference between the actual and predetermined actual warm end temperature differences;

means for varying, by an amount corresponding to the difference between the actual and predetermined LNG flow rates, the MRL flow rate;

means for varying the MRV flow rate to maintain an MRL/MRV ratio, which ratio is determined by the difference between the actual and calculated mid-point temperatures; and means for varying, by an amount corresponding to the difference between the actual and predetermined LNG temperatures, the actual LNG flow rate.

Also in accordance with an embodiment illustrated in FIG. 5, the invention provides a method of maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

comparing said predetermined LNG flow rate value with the actual LNG flow rate;

comparing said predetermined LNG temperature value with the actual LNG temperature;

comparing a predetermined value of the temperature difference between spent refrigerant leaving the warm end of the heat exchange means and a stream entering said warm end selected from MRL, MRV and the natural gas feed ("warm end temperature difference value") with the actual warm end temperature difference;

comparing the temperature of a stream at a location between the liquefying and subcooling sections of the heat exchanger means ("mid-point temperature") with a calculated temperature value, which is determined by the difference between the actual and predetermined actual warm end temperature differences;

varying, by an amount corresponding to the difference between the actual and predetermined LNG flow rates, the MRL flow rate;

varying the MRV flow rate to maintain an MRL/MRV ratio, which ratio is determined by the difference between the actual and calculated mid-point temperatures; and varying, by an amount corresponding to the difference between the actual and predetermined LNG temperatures, the actual LNG flow rate.

In accordance with a corresponding apparatus embodiment, the invention provides a control system for maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising:

means for comparing said predetermined LNG flow rate value with the actual LNG flow rate;

means for comparing said predetermined LNG temperature value with the actual LNG temperature;

means for comparing a predetermined value of the temperature difference between spent refrigerant leaving the warm end of the heat exchange means and a stream entering said warm end selected from MRL, MRV and the natural gas feed ("warm end temperature difference value") with the actual warm end temperature difference;

means for comparing the temperature of a stream at a location between the liquefying and subcooling sections of the heat exchanger means ("mid-point temperature") with a calculated temperature value, which is determined by the difference between the actual and predetermined actual warm end temperature differences;

means for varying, by an amount corresponding to the difference between the actual and predetermined LNG flow rates, the MRL flow rate;

means for varying the MRV flow rate to maintain an MRL/MRV ratio, which ratio is determined by the difference between the actual and calculated mid-point temperatures; and means for varying, by an amount corresponding to the difference between the actual and predetermined LNG temperatures, the actual LNG flow rate.

Referring to FIG. 1, natural gas is introduced via line 100 into the warm end of a first tube side of a heat exchanger 112 in which is it liquefied and then subcooled before leaving the heat exchanger at the cold end. Refrigeration duty in the heat exchange is provided by a multi component refrigerant ("MR") circulating in a closed loop. Spent refrigerant from the heat exchanger is fed via line 144 to a compressor 102 and the compressed refrigerant is partially condensed in a cooler 104 before separation in a phase separator 106. The liquid phase ("MRL") is fed via line 124 to a second tube side of the heat exchanger in which it is cooled before being throttled in valve 132 and introduced into the shell side of the heat exchanger 112 below the cold bundle. The vapor phase ("MRV") is fed via line 134 to a third tube side of the heat exchanger 112 in which it is cooled and then liquefied before being throttled in valve 138 and introduced into the shell side of the heat exchanger at the cold end. The liquid and condensed vapor portions vaporize in the heat exchanger and combine to provide the refrigerant feed to line 144.

The flow of LNG product is controlled by a valve 120 and the flows of the refrigerant portions to the heat exchanger are controlled by valves 132 and 138 respectively.

The temperature of the LNG product is compared in temperature indicator controller ("TIC") 114 against the required product temperature determined by an operator set point (SP). A signal proportionate to the difference in actual and required temperature is sent from the TIC 114 to a flow indicator controller ("FIC") 116, which in turn adjusts the position of the product valve 120 to maintain the required temperature. At constant refrigeration, an increase in product flow will reduce the actual product temperature and a decrease in product flow will reduce the actual product temperature. The product flow rate is monitored by the FIC 116 and a signal proportionate to the actual value ("PV") of the flow is sent from the FIC 116 to a FIC 122 for comparison with a set point value determined by the operator.

A signal proportionate to the difference between the actual and required product flow rates is sent to FIC 126, which compares the actual flow rate of the MRL with a required value set by that signal. The MRL control valve 132 is adjusted in response to differences between the actual and required flow rates in order to adjust the refrigeration in heat exchanger 112.

A signal proportionate to the difference between actual and required MRL flow rates is sent to a flow ratio indicator controller ("FRIC") 140 where it is compared with a signal from flow indicator ("FI") 136 measuring actual MRV flow rate in order to determine the actual MRV/MRL flow ratio. The actual MRV/MRL flow rate is compared with a set point value determined by a signal received from the temperature differential indicator controller ("TDIC") 142. A signal proportionate to the difference between the actual and required MRV/MRL flow ratios adjusts flow valve 138 and the corresponding refrigeration provided to the heat exchanger 112.

The TDIC 142 compares the actual temperature difference between the spent refrigerant in line 144 and the MRL in line 124 with a set point value determined by the operator. The set point signal provided by the TDIC 142 to the FRIC 140 is proportionate to that difference in temperature.

The TDIC 142 could measure temperature difference between the spent refrigerant and either the MRV in line 134 or the natural gas feed in line 100 instead of the difference with the MRL as shown in FIG. 1.

FI 136 could be located upstream instead of downstream of the heat exchanger 112. Similarly, the FIC 126 also could be located upstream instead of downstream of the heat exchanger 112.

It will be apparent that following operator change to the required LNG product flow rate, required LNG product temperature and/or warm end temperature difference ("WETD"), there will be resultant changes to valves 132 and 138 determined by the extent to which the flow rate, temperature and/or WETD have been changed. This will change the amount of refrigeration provided to the heat exchanger 112 and thereby change the difference between the actual and set LNG product temperature values. That change will adjust the valve 120 and hence the actual product flow rate. The change of the actual product flow rate will result in further adjustment valves 132 and 138 controlling the refrigeration supplied to the heat exchanger 112 and provide a corresponding change in the actual LNG product temperature.

Essentially simultaneously with actual change in product temperature, there will be a corresponding change in the WETD detected by TDIC 142 that will result in a corresponding change in the required MRV/MRL flow ratio of FRIC 140. Further, also essentially simultaneously with the change in actual product flow rate, there will be a corresponding change in product temperature that will cause, via the change in difference between actual and required product flow rates, change in refrigeration. Thus, the differences between actual and required product temperatures, actual and required LNG product flow rates and actual and required WETDs will automatically incrementally change in order to achieve the required combination of LNG product flow rate, LNG product temperature and WETD. Further, the control system will automatically change the refrigeration provided to the heat exchanger to maintain the set values if there is any change in LNG product flow rate, LNG product temperature or WETD arising from changes to any of those parameters not occasioned by changes to their required values, such as changes in NG composition, NG flow rate, partial condensation refrigeration duty for 104, ambient air temperature, cooling water temperature, or atmospheric pressure.

The control system of FIG. 2 differs from that of FIG. 1 in that the LNG product valve 120 is adjusted in response to changes in the WETD and the required MRV/MRL flow ratio is determined by the difference between the actual and required LNG product temperatures. In particular, the TDIC 142 sends a signal to FIC 116 instead of to FRIC 140 and TIC 114 sends a signal to FRIC 140 instead of FIC 116.

The control system of FIG. 3 differs from that of FIG. 2 in that the signal from TDIC 142 to FIC 116 is dependent upon the difference between the actual and required MRL flow rates. In particular, a signal proportionate to that difference is sent to a multiplier 300 to modify the signal from TDIC 142.

The control system of FIG. 4 differs from that of FIG. 1 in that the required MRV/MRL flow ratio is determined by the difference between actual and required temperatures at a mid-point of the heat exchanger 112 located between the liquefying and subcooling sections of the heat exchanger, typically between the cold and warm or middle bundles of the heat exchanger. A TIC 400 has a set point determined by the operator and compares that set point with the actual mid-point temperature. The mid-point temperature can be that on the shell side of the heat exchanger 112 as shown in FIG. 4 or could be the temperature of the LNG or MRL or MRV at an appropriate location in the relevant tube section. In this embodiment adjustment of the MRL flow rate by valve 132 in response to the difference between the actual and required MRV flow rates is overridden by a FIC 326 responsive to the WETD if the actual difference differs from the required difference by a predetermined amount.

The control system of FIG. 5 differs from that of FIG. 4 in that the required mid-point temperature is not operator set but is determined by the difference between actual and required WETDs. In particular, a signal from TDIC 142 no longer provides an override to the FIC 126 control of valve 132 but provides a set point for TIC 400.

Figure 6:
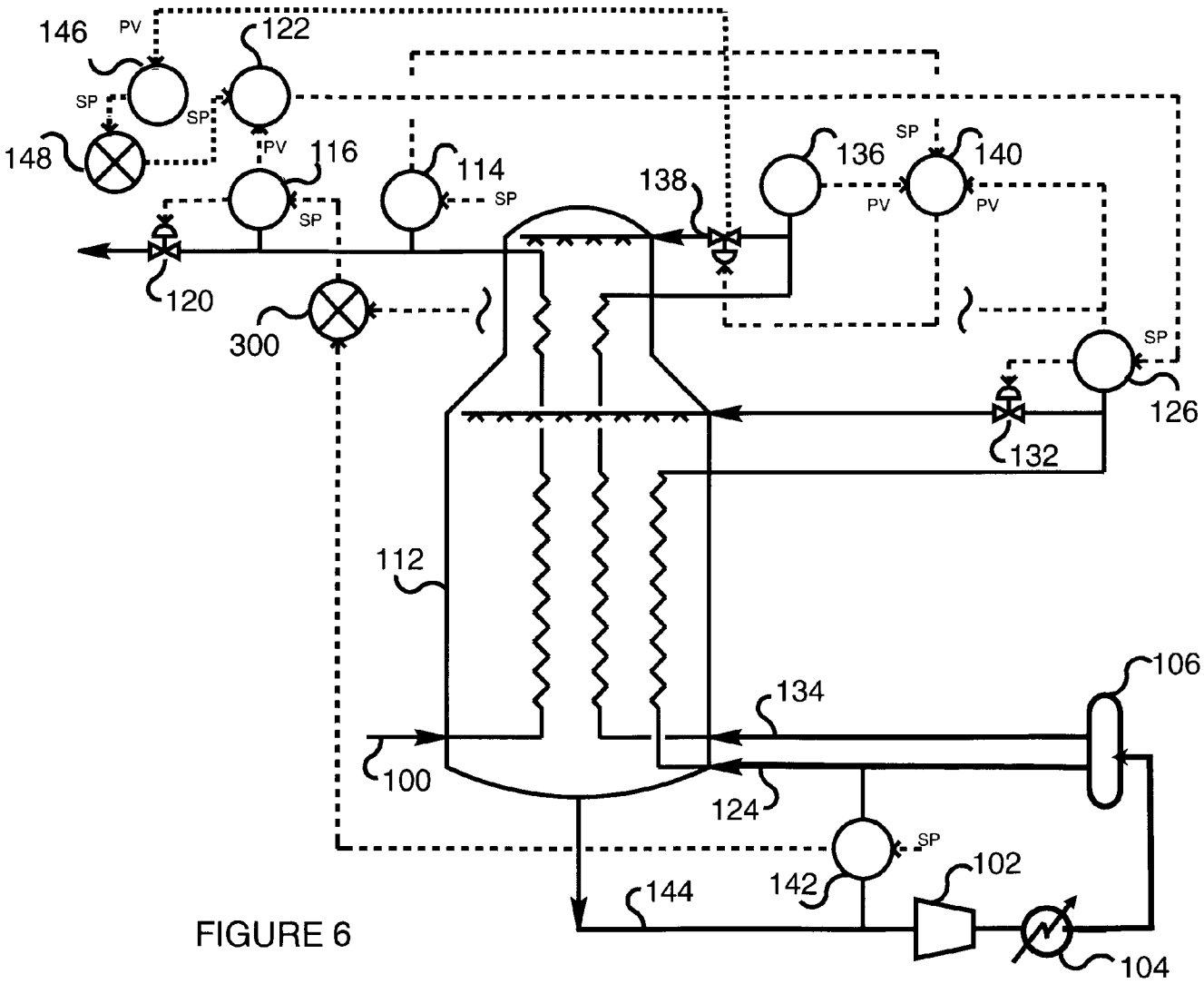
FIG. 6 is a schematic flow diagram of a modification of the mixed refrigerant LNG plant process of FIG. 3.

The control system of FIG. 6 differs from that of FIG. 3 in that a constraint controller 146 limits the opening of the MRV valve 138 to, for example 90%, by adjusting a "Production Factor" that is multiplied by multiplier 148 to produce an LNG Master Flow Controller set point. When the system is in control and the valve 138 is open less than the set 90% (or other predetermined maximum) amount the controller 146 provides a Production Factor of 1 and does not limit production. However, if the valve position exceeds 90% (or other predetermined maximum) amount, then the controller would begin to reduce the Production Factor until the system was in control with the required maximum valve position.

It is a common feature of all of the exemplified embodiments that there is no change in LNG product flow rate except in response to changes in refrigeration duty for the heat exchanger 112.

EXAMPLES

Figure 7:
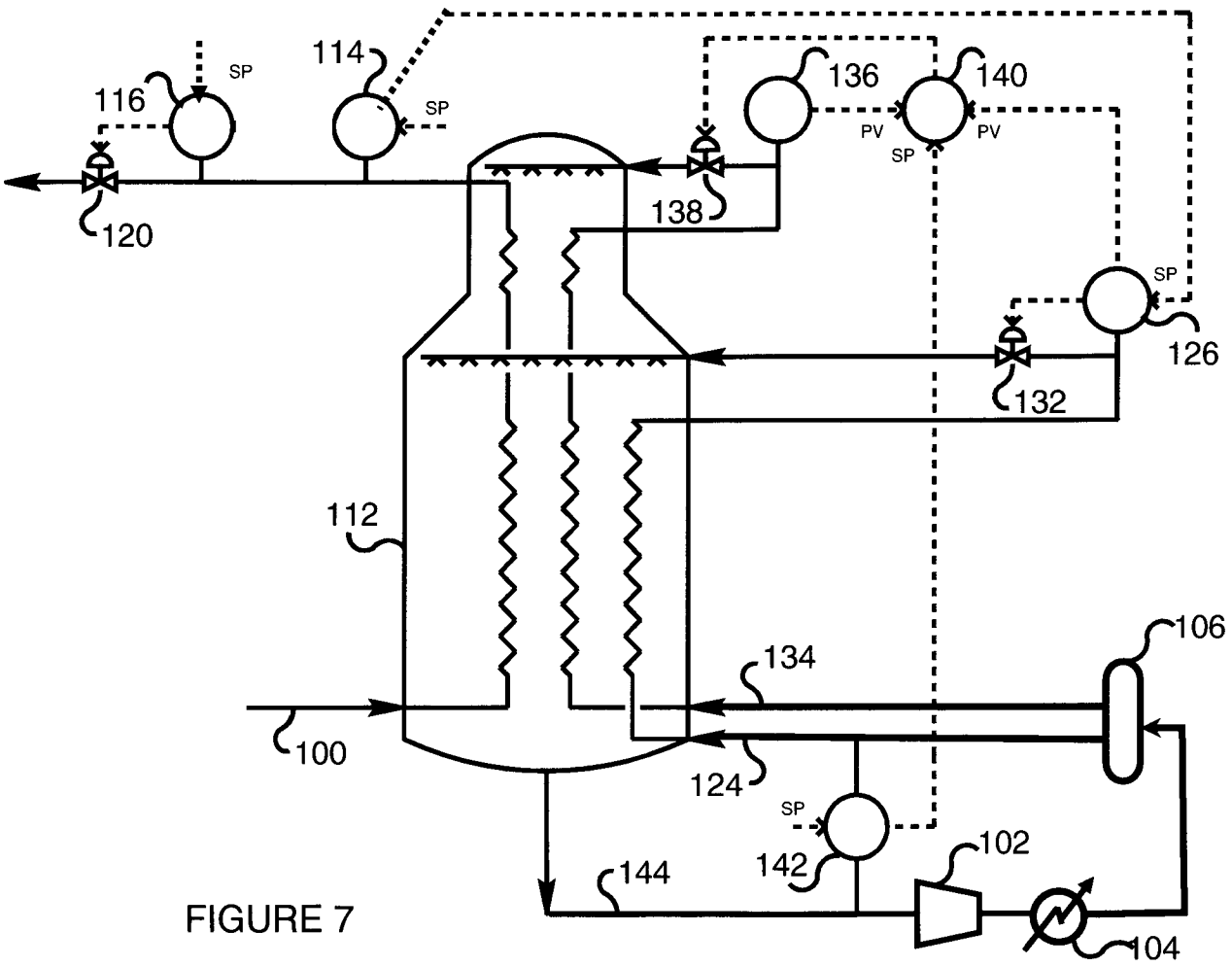
FIG. 7 is a schematic flow diagram of a comparative mixed refrigerant LNG plant process.

Each of the embodiments of FIGS. 2 to 5 and the comparative process of FIG. 7 was subject to the following disturbances:

Increase LNG rundown temperature from −247° F. (−155° C.) to −245° F. (−153.9° C.) in 24 minutes;

Decrease production by 5% while simultaneously decreasing turbine speed by 1% in 24 minutes; and Increase production by 2.8% in 24 minutes.

The process of FIG. 7 differs from that of FIG. 1 in that the LNG product flow rate is directly adjusted to the required value and FIC 126 is controlled by the difference between actual and desired LNG product temperature difference Response to Increase LNG Rundown Temperature The process of FIG. 1 had some oscillations in its response to the increased rundown temperature with both the LNG flow rate and the LNG temperature oscillating somewhat as they reached the new steady state. It is believed that this was more a result of conflict between the two controllers rather than a tuning issue. The process of FIG. 7 did not oscillate but did take a long time to reach the new steady state, which is believed to have been a function of tuning rather than controller interaction. The process of FIG. 2 exhibited much tighter control of the temperature with little disturbance to the rest of the system. The process of FIG. 3 showed similar ability to that of FIG. 2 in tracking the LNG temperature set point and slightly less disturbances to the rest of the system. Both of the processes of FIGS. 2 and 3 showed the best response to this disturbance.

Decrease LNG Production with Simultaneous Turbine Speed Reduction

The process of FIG. 1 had difficulty in following the LNG production set point taking 2 hours to return to steady state. During that time, the LNG temperature had deviations as large as 2° F. (1.1° C.) warmer before finally reaching steady state over 2 hours after the disturbance began. The process of FIG. 7, with its direct control over LNG flow rate had excellent tracking of the LNG production set point, but also saw large temperature swings before finally reaching steady state almost 3 hours after the disturbance. The process of FIG. 2 lagged in the tracking of the LNG production set point taking two hours to reach steady state, but maintained tight LNG temperature control throughout the disturbance. The process of FIG. 3 tracked the set point of the LNG production very well reaching steady state within an hour of the beginning of the disturbance and maintaining tight temperature control throughout.

LNG Production Increase

The process of FIG. 1 took 2 hours to reach the desired set point as well as allowing the LNG temperature to drift cold by 1° F. (0.55° C.) before returning to its set point. The process of FIG. 3 experienced a more than 1° F. (0.55° C.) warming of the LNG before returning to steady state in close to 3 hours. The process of FIG. 2 took 3 hours to reach the new production set point, but maintained excellent temperature control throughout. The process of FIG. 3 showed excellent response to the production change and maintained tight temperature control.

Unattainable Production

Although the increased production disturbance was easily achieved by the exemplified embodiments of the invention, there still remained a question as to how the systems would respond to a truly unattainable production disturbance. Accordingly, the process of FIG. 3 was subjected to a disturbance where the production set point was raised to 7% higher than the current steady state. The simulation was also set up to simulate bog down of the MR turbine 102 and additional parameters were monitored to determine the systems responsiveness.

The system tracked the LNG production to the new set point, however, the LNG temperature continued to rise driving the MRV valve 138 fully open. The LNG temperature finally settled out approximately 4° F. (2.2° C.) warmer than the desired LNG temperature. The mid point temperature between the middle and cold bundles of the heat exchanger 112 warmed up by close to 20° F. (11° C.). The increased MRV flow almost doubled the cold bundle pressure drop. The gas turbine reached full power and then bogged down reducing its speed by approximately 1%. The results showed that the control system had no checks to prevent it from reaching an unacceptable new operating point.

The process of FIG. 6 overcomes this problem by providing a check to prevent the control system from reaching an undesirable operating point. With the controller 146 set to limit the valve opening to 90%, the 7% production increase limited production to a 4.8% increase and maintained control of the LNG temperature throughout and did not bog down the MR turbine 102.

Other embodiments and benefits of the invention will be apparent to those skilled in the art from a consideration of the specification and from practice of the invention disclosed herein. It is intended that this specification be considered as exemplary only with modifications and variations being within the scope and spirit of the invention as defined by the following claim. In particular, any of the exemplified embodiments could be used for liquefaction of gases other than natural gas and the tube and shell heat exchanger 112 could be replaced by two or more individual heat exchanges arranged in series and/or by any of the heat exchanger types known in the art.

The invention claimed is:

1. A method of maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

comparing said predetermined LNG flow rate value with the actual LNG flow rate and generating a signal proportionate to the difference between the actual and predetermined LNG flow rates;

comparing said predetermined LNG temperature value with the actual LNG temperature and generating a signal proportionate to the difference between the actual and predetermined LNG temperatures;

(i) comparing a predetermined value of the temperature difference between spent refrigerant leaving the warm end of the heat exchange means and a stream entering said warm end selected from MRL, MRV and the natural gas feed ("warm end temperature difference") with the actual warm end temperature difference and generating a signal proportionate to the difference between the actual and predetermined warm end temperature differences and/or (ii) comparing a predetermined value of the temperature ("mid-point temperature") of a stream at a location between the liquefying and subcooling sections of the heat exchanger means with the actual mid-point temperature and generating a signal proportionate to the difference between the actual and predetermined mid-point temperatures;

varying, in response the signal proportionate to the difference between the actual and predetermined LNG flow rates and by an amount corresponding to the difference between the actual and predetermined LNG flow rates, one of the MRL and MRV flow rates; and either (i) varying, in response to the signal proportionate to the difference between the actual and predetermined LNG temperatures, the other of the MRV and MRL flow rates to maintain an MRL/MRV ratio, which ratio is determined by the difference between the actual and predetermined LNG temperatures, and (ii) varying, in response to the signal proportionate to the difference between the actual and predetermined warm end temperature differences or mid-point temperatures and by an amount corresponding to the difference between the actual and predetermined warm end temperature differences or mid-point temperatures, the actual LNG flow rate; or (i) varying, in response to the signal proportionate to the difference between the actual and predetermined warm end temperature differences or mid-point temperatures, the other of the MRV and MRL flow rates to maintain an MRL/MRV ratio, which ratio is determined by the difference between the actual and predetermined warm end temperature differences or mid-point temperatures, and (ii) varying, in response to the signal proportionate to the difference between the actual and predetermined LNG temperatures and by an amount corresponding to the difference between the actual and predetermined LNG temperatures, the actual LNG flow rate.

2. The method of claim 1, wherein the MRL flow rate varies by an amount corresponding to the difference between the actual and predetermined LNG flow rates.

3. The method of claim 1, wherein the MRL flow rate varies by an amount corresponding to the difference between the actual and predetermined warm end temperature differences.

4. The method of claim 1, wherein the MRL flow rate varies by an amount corresponding to the difference between the actual and predetermined mid-point temperatures.

5. The method of claim 1, wherein the MRL/MRV ratio is determined by the difference between the actual and predetermined LNG temperatures.

6. The method of claim 1, wherein the MRL/MRV ratio is determined by the difference between the actual and predetermined warm end temperature differences.

7. The method of claim 1, wherein the MRL/MRV ratio is determined by the difference between actual and predetermined mid-point temperatures.

8. A method of claim 1 wherein said predetermined values are adjustable and the method further comprises the steps of:

setting the predetermined flow rate value for the LNG outlet;

setting the predetermined temperature value for the LNG outlet stream and; and setting the predetermined value of (i) the warm end temperature difference value or (ii) the mid-point temperature.

9. The method of claim 8, wherein the MRL flow rate varies by an amount corresponding to the difference between the actual and predetermined LNG flow rates.

10. The method of claim 8, wherein the MRL flow rate varies by an amount corresponding to the difference between the actual and predetermined warm end temperature differences.

11. The method of claim 8, wherein the MRL flow rate varies by an amount corresponding to the difference between the actual and predetermined mid-point temperatures.

12. The method of claim 9, wherein the MRL/MRV ratio is determined by the difference between the actual and predetermined LNG temperatures.

13. The method of claim 12, wherein the MRL/MRV ratio is determined by the difference between the actual and predetermined warm end temperature differences.

14. The method of claim 12, wherein the MRL/MRV ratio is determined by the difference between actual and predetermined mid-point temperatures.

15. A method of maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

comparing said predetermined LNG flow rate value with the actual LNG flow rate and generating a signal proportionate to the difference between the actual and predetermined LNG flow rates;

comparing said predetermined LNG temperature value with the actual LNG temperature and generating a signal proportionate to the difference between the actual and predetermined LNG temperatures;

comparing a predetermined value of the temperature difference between spent refrigerant leaving the warm end of the heat exchange means and a stream entering said warm end selected from MRL, MRV and the natural gas feed ("warm end temperature difference ") with the actual warm end temperature difference and generating a signal proportionate to the difference between the actual and predetermined warm end temperature differences;

varying, in response the signal proportionate to the difference between the actual and predetermined LNG flow rates and by an amount corresponding to the difference between the actual and predetermined LNG flow rates, the MRL flow rate;

varying, in response to the signal proportionate to the difference between the actual and predetermined LNG temperatures, the MRV flow rate to maintain an MRL/MRV ratio, which ratio is determined by the difference between the actual and predetermined LNG temperatures; and varying, in response to the signal proportionate to the difference between the actual and predetermined warm end temperature differences and by an amount corresponding to the difference between the actual and predetermined warm end temperature differences, the actual LNG flow rate.

16. The method of claim 15 wherein said predetermined values are adjustable and the method further comprises the steps of:

setting the predetermined flow rate value for the LNG outlet stream;

setting the predetermined temperature value for the LNG outlet stream; and setting the predetermined value of the warm end temperature difference value.

17. A method of maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, comprising the steps of:

comparing said predetermined LNG flow rate value with the actual LNG flow rate and generating a signal proportionate to the difference between the actual and predetermined LNG flow rates;

comparing said predetermined LNG temperature value with the actual LNG temperature and generating a signal proportionate to the difference between the actual and predetermined LNG temperatures;

comparing a predetermined value of the temperature difference between spent refrigerant leaving the warm end of the heat exchange means and a stream entering said warm end selected from MRL, MRV and the natural gas feed ("warm end temperature difference ") with the actual warm end temperature difference and generating a signal proportionate to the difference between the actual and predetermined warm end temperature differences;

varying, in response the signal proportionate to the difference between the actual and predetermined LNG flow rates and by an amount corresponding to the difference between the actual and predetermined LNG flow rates, the MRL flow rate;

varying, in response to the signal proportionate to the difference between the actual and predetermined LNG temperatures, the MRV flow rate to maintain an MRL/MRV ratio, which ratio is determined by the difference between the actual and predetermined LNG temperatures; and varying, in response to the signal proportionate to the difference between the actual and predetermined warm end temperature differences and by an amount corresponding to the difference between the actual and predetermined warm end temperature differences multiplied by a value proportionate to the required variation in MRL flow rate, the actual LNG flow rate.

18. The method of claim 17 wherein said predetermined values are adjustable and the method further comprises the steps of:

setting the predetermined flow rate value for the LNG outlet stream;

setting the predetermined temperature value for the LNG outlet stream; and setting the predetermined value of the warm end temperature difference value.

19. A control system for maintaining at a predetermined flow rate value and at a predetermined temperature value the liquefied natural gas ("LNG") outlet stream of a natural gas liquefaction using heat exchange means, having a warm end to which the natural gas is fed, a liquefying section in which the natural gas is liquefied, a subcooling section in which the liquefied natural gas is subcooled and a cold end from which said LNG outlet stream is withdrawn, in which refrigeration duty is provided in the liquefying section by a first refrigerant ("MRL") cooled in said heat exchange means and supplied for refrigeration duty at an MRL flow rate and in the subcooling section by a second refrigerant ("MRV") cooled in said heat exchange means and supplied for refrigeration duty at an MRV flow rate, said system comprising:

means for comparing the predetermined flow rate value for the LNG outlet stream with the actual LNG flow rate;

means for comparing the predetermined temperature value for the LNG outlet stream with the actual LNG temperature;

means for comparing a predetermined value of (i) the temperature difference between spent refrigerant leaving the warm end of the heat exchange means and a stream entering said warm end selected from MRL, MRV and the natural gas feed ("warm end temperature difference value") or (ii) the temperature ("mid-point temperature") of a stream at a location between the liquefying and subcooling sections of the heat exchanger means with respectively (i) the actual warm end temperature difference or (ii) the actual mid-point temperature;

means for varying one of the MRL and MRV flow rates, said means being configured to receive a signal proportionate to the difference between the actual and predetermined LNG flow rates and to vary said one of the MRL and MRV flow rates by an amount corresponding to the difference between the actual and predetermined LNG flow rates; and either (i) means for varying the other of the MRV and MRL flow rates to maintain an MRL/MRV ratio, said means being configured to receive a signal proportionate to the difference between the actual and predetermined LNG temperatures, and said MRL/MRV ratio being determined by the difference between the actual and predetermined LNG temperatures, and (ii) means for varying the actual LNG flow rate, said means being configured to receive a signal proportionate to the difference between the actual and predetermined warm end temperature differences or mid-point temperatures and to vary said LNG flow rate by an amount corresponding to said difference between the actual and predetermined warm end temperature differences or mid-point temperatures; or (i) means for varying the other of the MRV and MRL flow rates to maintain an MRL/MRV ratio, said means being configured to receive a signal proportionate to the difference between the actual and predetermined warm end temperature differences or mid-point temperatures, and said MRL/MRV ratio being determined by the difference between the actual and predetermined warm end temperature differences or mid-point temperatures, and (ii) means for varying the actual LNG flow rate, said means being configured to receive a signal proportionate to the difference between the actual and predetermined LNG temperatures and to vary said LNG flow rate by an amount corresponding to said difference between the actual and predetermined LNG temperatures.

* * * * *